US007624587B2

(12) United States Patent
Lee et al.

(10) Patent No.: US 7,624,587 B2
(45) Date of Patent: Dec. 1, 2009

(54) MULTI-STAGE OPERATION TYPE AIR CONDITIONER

(75) Inventors: Joong Hee Lee, Ansan-Si (KR); Hyoung Seo Choi, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 618 days.

(21) Appl. No.: 11/086,570

(22) Filed: Mar. 23, 2005

(65) Prior Publication Data

US 2005/0257560 A1 Nov. 24, 2005

(30) Foreign Application Priority Data

May 18, 2004 (KR) ..... 10-2004-0035195

(51) Int. Cl.
*F25B 1/10* (2006.01)

(52) U.S. Cl. ..... 62/228.1; 62/510; 62/426

(58) Field of Classification Search ..... 62/48.1, 62/263, 285, 298, 510, 179, 150, 181, 186, 62/228.1, 426; 165/11.1, 47, 48.1
See application file for complete search history.

(56) References Cited

U.S. PATENT DOCUMENTS 2,451,366 A * 10/1948 Terry ..... 62/427
2,747,378 A * 5/1956 Noone ..... 62/282
3,402,564 A * 9/1968 Nussbaum ..... 62/173
4,104,890 A * 8/1978 Iwasaki ..... 62/324.1
4,122,686 A * 10/1978 Lindahl et al. ..... 62/81
4,549,601 A * 10/1985 Wellman et al. ..... 165/205
4,951,475 A * 8/1990 Alsenz ..... 62/117
4,958,500 A * 9/1990 Kuroda et al. ..... 62/89
5,009,077 A * 4/1991 Okoshi et al. ..... 62/160
5,050,397 A * 9/1991 Sugiyama et al. ..... 62/175
5,094,598 A * 3/1992 Amata et al. ..... 417/533
5,279,131 A * 1/1994 Urushihata et al. ..... 62/324.1
5,344,069 A * 9/1994 Narikiyo ..... 236/49.3
5,435,144 A * 7/1995 Kalmbach ..... 62/84
5,461,875 A * 10/1995 Lee et al. ..... 62/89

(Continued)

FOREIGN PATENT DOCUMENTS

JP 02082074 A * 3/1990

(Continued)

OTHER PUBLICATIONS

English abstract for foreign patent JP02-082074.*

*Primary Examiner*—William E Tapolcai
(74) *Attorney, Agent, or Firm*—Sughrue Mion, PLLC

(57) ABSTRACT

A multi-stage operation type air conditioner which can be operated in various cooling or heating capacities. The multi-stage operation type air conditioner includes a first discharge port, a first opening/closing device for opening or closing the first discharge port, a second discharge port having a size different from that of the first discharge port, a second opening/closing device for opening or closing the second discharge port, and a controller for controlling the air conditioner such that the air conditioner may be operated with one of the first and second discharge ports opened, in an operation with a lower cooling or heating load, and the air conditioner may be operated with both the first and second discharge ports opened, in an operation with a higher cooling or heating load.

10 Claims, 5 Drawing Sheets

U.S. PATENT DOCUMENTS

| | | | | |
|---|---|---|---|---|
| 5,575,326 | A * | 11/1996 | Asami et al. | 165/124 |
| 5,642,856 | A * | 7/1997 | Samukawa et al. | 236/49.3 |
| 5,673,570 | A * | 10/1997 | Sada | 62/468 |
| 5,979,167 | A * | 11/1999 | Kochavi et al. | 62/186 |
| 6,086,324 | A * | 7/2000 | Ikeda et al. | 415/53.1 |
| 6,491,094 | B2 * | 12/2002 | Rayburn et al. | 165/250 |
| 6,747,872 | B1 * | 6/2004 | Patel et al. | 361/695 |
| 6,766,653 | B2 * | 7/2004 | Hong | 62/228.3 |
| 2002/0073721 | A1 * | 6/2002 | Seo et al. | 62/228.3 |
| 2003/0230098 | A1 * | 12/2003 | Moon et al. | 62/175 |
| 2003/0230100 | A1 * | 12/2003 | Hwang, II | 62/184 |
| 2003/0230102 | A1 * | 12/2003 | Hong | 62/228.3 |

FOREIGN PATENT DOCUMENTS

| | | | |
|---|---|---|---|
| KR | 20-1990-0003353 | U | 2/1990 |
| KR | 10-1995-0019520 | A | 7/1995 |
| KR | 10-2000-0039579 | A | 7/2000 |
| KR | 10-0378822 | B1 | 4/2003 |
| KR | 10-0432225 | B1 | 5/2004 |

* cited by examiner

FIG. 5

| Kind of operation | State of discharging port | State of heat exchange valve | State of compressor | State of bypass valve |
|---|---|---|---|---|
| First stage | First discharging port is opened.<br>Second discharging port is closed. | First heat exchange valve is opened.<br>Second heat exchange valve is closed. | First compressor is ON.<br>Second compressor is OFF. | Opened |
| Second stage | First discharging port is closed.<br>Second discharging port is opened. | First heat exchange valve is closed.<br>Second heat exchange valve is opened. | First compressor is OFF.<br>Second compressor is ON. | Closed |
| Third stage | First discharging port is opened.<br>Second discharging port is opened. | First heat exchange valve is opened.<br>Second heat exchange valve is opened. | First compressor is ON.<br>Second compressor is ON. | Closed |

MULTI-STAGE OPERATION TYPE AIR CONDITIONER

CROSS-REFERENCE TO RELATED APPLICATION

This application claims the benefit of Korean Patent Application No. 2004-35195, filed on May 18, 2004 in the Korean Intellectual Property Office, the disclosure of which is incorporated herein by reference.

BACKGROUND OF THE INVENTION

1. Field of the Invention

An apparatus consistent with the present invention relates to a multi-stage operation type air conditioner and, more particularly, to a multi-stage operation type air conditioner, which is able to operate with a variety of cooling or heating capacities.

2. Description of the Related Art

Generally, a conventional air conditioner consists of one indoor unit and one outdoor unit. The indoor unit is equipped with an indoor heat exchanger for exchanging the heat of air in a room, and with a discharge port for discharging chilled air in the indoor unit to the outside of the indoor unit. The outdoor unit is equipped with a compressor for compressing a refrigerant, an outdoor heat exchanger for exchanging the heat of outside air, and an electronic expansion valve for expanding the refrigerant.

In such a conventional air conditioner, when a user inputs an operating command, a microcomputer in the air conditioner controls the number of rotations of the compressor (in the case of a rotary compressor), or controls an opening of a motor operating valve and the number of rotations of a blowing fan, based on data input through various sensors, thereby allowing a temperature in the room to reach a desired temperature. That is, when the user sets a high stage operation accompanied with a large quantity of air discharge, the microcomputer increases the number of rotations of the compressor, and the number of rotations of the blowing fan, thereby increasing a cooling or heating capacity, or when the user sets a low stage operation, the microcomputer lowers the number of rotations of the compressor, and the number of rotations of the blowing fan, thereby decreasing the cooling or heating capacity.

However, such a conventional air conditioner has a problem in that, since a degree of variation in cooling or heating capacity by changing the number of rotations of the compressor and the number of rotations of the blowing fan is small, an appropriate cooling or heating according to a variation of cooling or heating load cannot be performed. For instance, in a case where an air conditioner having a rated load for cooling or heating only a living room is equipped in a living room of an interior space consisting of three rooms and one living room, and is then used with the two rooms opened, even if the air conditioner is operated with the maximum cooling or heating capacity, a pleasant conditioned state cannot be achieved since the degree of variation in a temperature of the interior space is small.

On the contrary, in a case where the air conditioner is equipped for cooling or heating only one room, and the room is partitioned into two small rooms, the air conditioner performs a cooling or heating operation for one small room with a compressor having a compressing capacity larger than the compressing capacity needed for the small room, and with a heat exchanger having a heat exchanging capacity larger than the heat exchanging capacity needed for the small room, thereby consuming an unnecessary amount of energy.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

An apparatus consistent with the present invention has been made in view of the problems involved with the prior art, and one aspect of the present invention is to provide a multi-stage operation type air conditioner, which can be operated at various cooling or heating capacities.

Additional aspects and/or advantages of the invention will be set forth in part in the description which follows and, in part, will be apparent from the description, or may be learned by practice of the invention.

In accordance with one aspect, the present invention provides a multi-stage operation air conditioner, comprising: a first discharge port; a first opening/closing device which opens or closes the first discharge port; a second discharge port having a size different from that of the first discharge port; a second opening/closing device which opens or closes the second discharge port; and a controller which controls the air conditioner such that when being operated with a lower cooling or heating load, the air conditioner may be operated with one of the first and second discharge ports opened, and when being operated with a lower cooling or heating load, the air conditioner may be operated with both the first and second discharge ports opened.

BRIEF DESCRIPTION OF THE DRAWINGS

These and/or other aspects and advantages consistent with the invention will become apparent and more readily appreciated from the following description of the exemplary embodiments, taken in conjunction with the accompanying drawings, in which:

FIG. 5 is a table showing an operating state of the respective devices when the air conditioner of FIG. 1 is operated in each of multi-stages.

DETAILED DESCRIPTION OF ILLUSTRATIVE, NON-LIMITING EMBODIMENTS OF THE INVENTION

Figure 1:
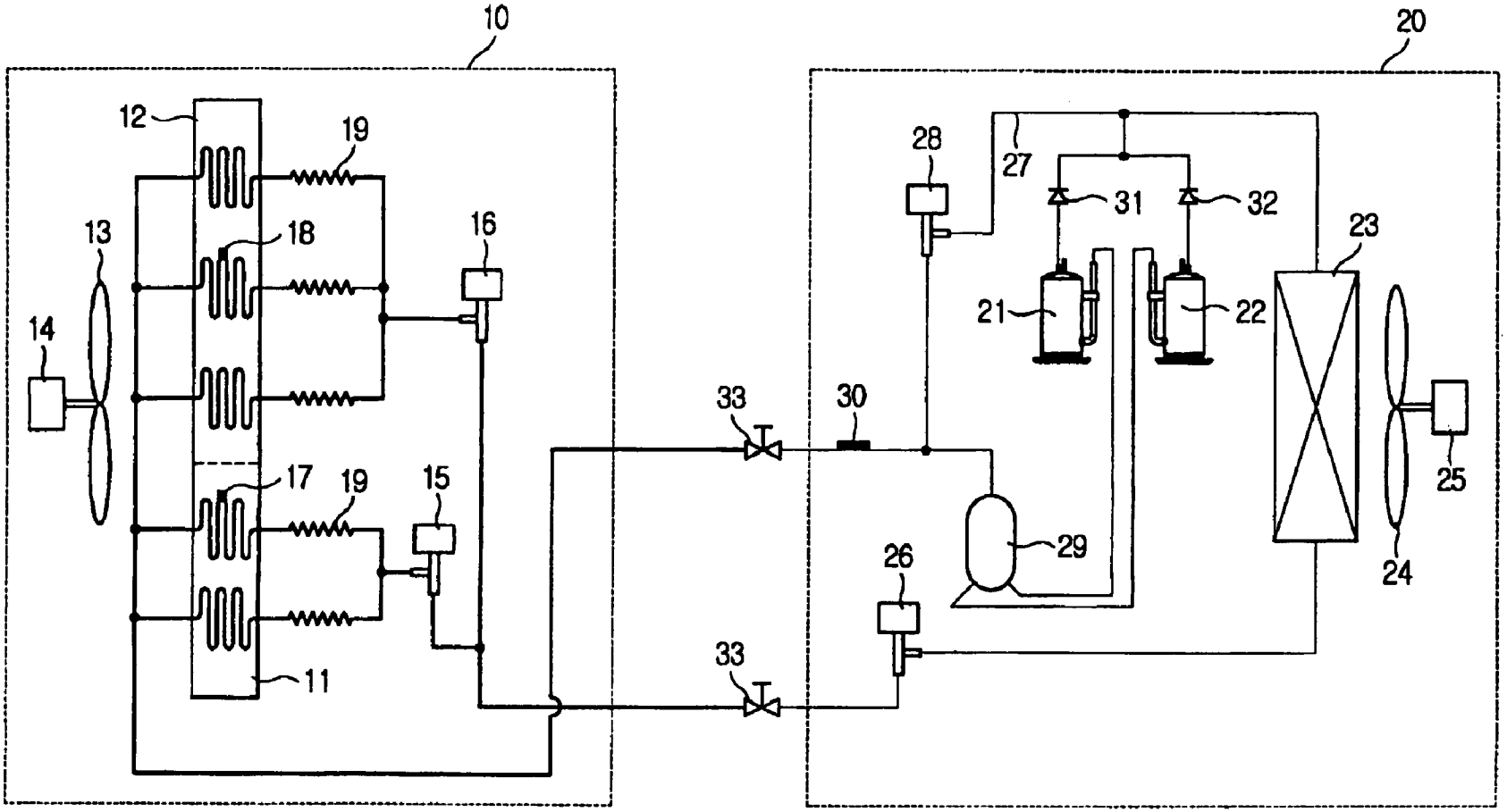
FIG. 1 is a schematic diagram illustrating a refrigerant path of an air conditioner according to one exemplary embodiment of the present invention.

Reference will now be made in detail to the illustrative, non-limiting embodiments consistent with the present invention, examples of which are illustrated in the accompanying drawings, wherein like reference numerals refer to the like elements throughout. The embodiments are described below to explain the present invention by referring to the figures.

As shown in FIG. 1, an air conditioner according to one embodiment of the present invention comprises an indoor unit 10, and an outdoor unit 20 connected to the indoor unit 10.

The indoor unit 10 comprises: first and second heat exchangers 11 and 12 for performing heat exchange for air taken in from the interior space; an indoor fan 13 for forcing air of the interior space to be taken in from the outside of the indoor unit 10, to pass through first and second heat exchangers 11 and 12, and to be discharged to the outside of the indoor unit 10; and an indoor fan motor 14 for rotating the indoor fan 13. Additionally, the indoor unit 10 comprises: a first heat exchanger valve 15 for controlling a flow of a refrigerant flowing into the first heat exchanger 11; a second heat exchanger valve 16 for controlling a flow of a refrigerant flowing into the second heat exchanger 12; a first heat exchanger temperature sensor 17 for measuring a temperature of the refrigerant flowing in the first heat exchanger 11; and a second heat exchanger temperature sensor 18 for measuring a temperature of the refrigerant flowing in the second heat exchanger 12. Furthermore, intake sides of the first and second heat exchangers 11 and 12 are connected with capillary pipes 19, respectively.

The second heat exchanger 12 has a refrigerant pipe with an area larger than that of the first heat exchanger 11. Accordingly, the second heat exchanger 12 has a heat exchanging capacity higher than that of the first heat exchanger 11.

Meanwhile, the outdoor unit 20 comprises first and second compressors 21 and 22 for compressing the refrigerant; a third heat exchanger 23 for exchanging heat of the refrigerant compressed in the first and second compressors 21 and 22 with outside air; an outdoor fan 24 for forcibly blowing the outside air to the third heat exchanger 23; and an outdoor fan motor 25 for rotating the outdoor fan 24.

Furthermore, the outdoor unit 20 comprises an electronic expansion valve 26 for expanding the refrigerant sent from the third heat exchanger 23 and for controlling the flow of refrigerant discharged from the third heat exchanger 23; a bypass pipe 27 for bypassing a portion of the refrigerant discharged from the first and second compressors 21 and 22 toward an intake side of the first or second compressor 21 or 22; a bypass valve 28 equipped in the bypass pipe 27; an accumulator 29 for transferring the refrigerant discharged from the first and second heat exchangers 11 and 12 to the first and second compressors 21 and 22 in a gaseous state, respectively; and a discharging temperature sensor 30 for measuring a temperature of the refrigerant transferred to the first and second compressors 21 and 22 from the first and second heat exchangers 11 and 12, respectively.

The second compressor 22 has a compressing capacity larger than that of the first compressor 21. Discharging sides of the first and second compressors 21 and 22 are equipped with first and second check valves 31 and 32. With the configuration of the first and second check valves 31 and 32, in a case where one of the first and second compressors 21 and 22 is previously driven, and the other compressor is then driven with a discharging pressure of the previously driven compressor, driving errors of the other compressor can be prevented.

The discharging temperature sensor 30 may be used for restricting an overheat degree along with the first and second heat exchanger temperature sensors 17 and 18. The term "overheat degree" means a difference between a temperature in the pipe of the heat exchanger and a temperature at the discharging side of the heat exchanger.

It is desirable in view of efficiency of the system to maintain the overheat degree at an appropriate level, and this is attributed to the fact that an excessively low overheat degree causes a higher possibility of liquid refrigerant to flow in the heat exchanger, and an excessively high overheat degree causes an overheat of the compressor and reduction in efficiency of the compressor. Accordingly, if the difference between a temperature of the first and second heat exchanger temperature sensors 17 and 18, and a temperature of the discharging temperature sensor 30 is not identical to a set value (for instance, 5), the overheat degree is not appropriate, and it is desirable that the overheat degree should be adjusted by changing an opening amount of the electronic expansion valve 26.

Each of the pipes for connecting the indoor unit 10 and the outdoor unit 20 is provided with a connection valve 33 at a position near to the outdoor unit 20, whereby the pipes for connecting the indoor unit 10 and the outdoor unit 20 can be easily connected.

Figure 2:
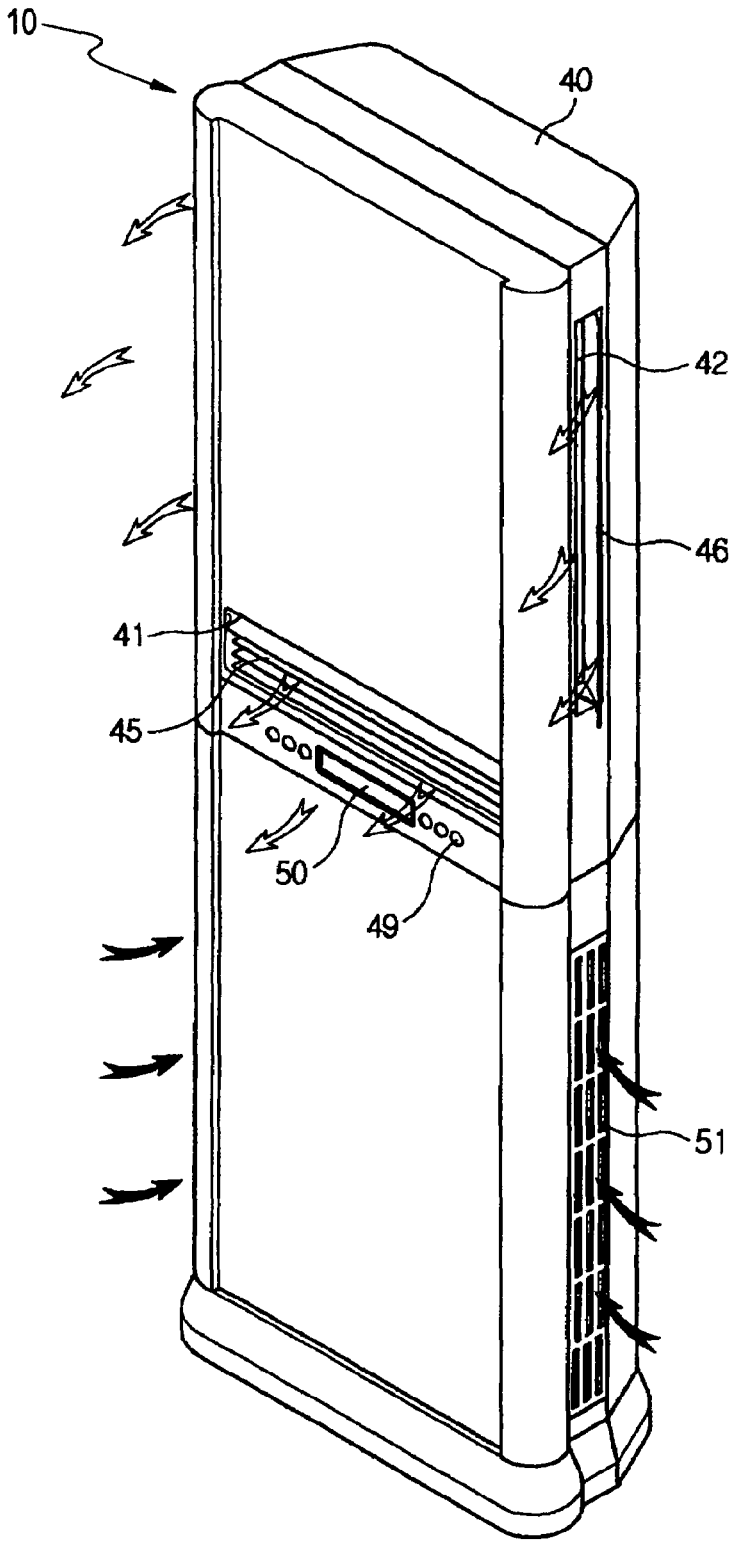
FIG. 2 is a perspective view illustrating an indoor unit of the air conditioner shown in FIG. 1.
Figure 3:
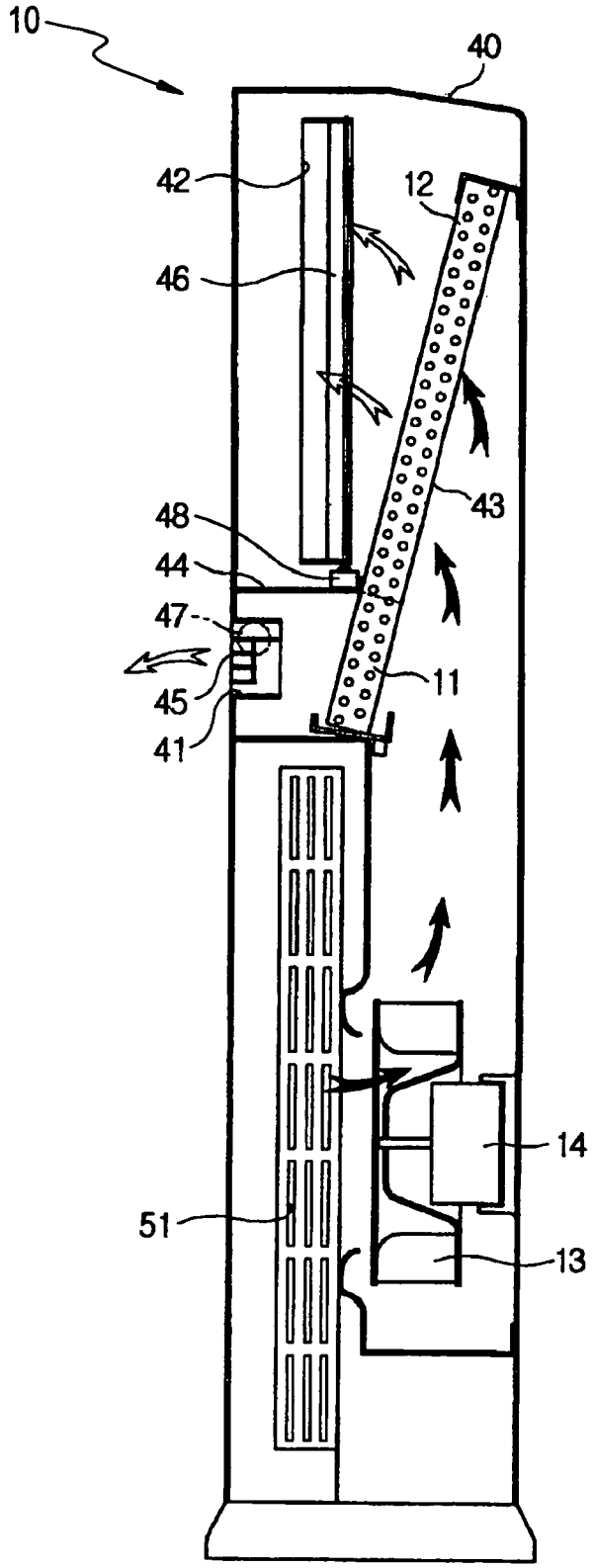
FIG. 3 is a cross-sectional view illustrating the indoor unit of the air conditioner shown in FIG. 1.

As shown in FIGS. 2 and 3, the indoor unit 10 of the air conditioner according to one embodiment of the present invention is provided at a front side of a body 40 with a first discharging port 41, and at either upper side of the body 40 with a second discharging port 42 having a size larger than the first discharging port 41.

Furthermore, the first and second heat exchangers 11 and 12 are provided in an upper portion of the body 40, in which the first and second heat exchangers 11 and 12 are fixed to an identical establishment plate 43. Between a position adjacent to both the first and second heat exchangers 11 and 12, and a front side of the body 40, a partition panel 44 is provided for dividing a front space of the first heat exchanger 11 and a front space of the second heat exchanger 12. The partition panel 44 prevents air of the interior space passing through the first heat exchanger 11 from being discharged to the second discharging port 42 or prevents air of the interior space passing through the second heat exchanger 12 from being discharged to the first discharging port 41, thereby forcing air of the interior space passing through the first heat exchanger 11 to be discharged to the first discharging port 41 while forcing air of the interior space passing through the second heat exchanger 12 to be discharged to the second discharging port 42.

The first discharging port 41 is equipped with a first blade or slat 45 for opening or closing the first discharging port 41, and an opening angle of the first blade 45 is controlled by rotation of a first motor 47. Furthermore, the second discharging port 42 is equipped with a second blade or slat 46 for opening or closing the second discharging port 42, and an opening angle of the second blade 46 is controlled by rotation of a second motor 48.

The first discharging port 41 is provided at a lower portion thereof with an input portion 49 for inputting a control command, and with a display portion 50 for displaying an operational state of the air conditioner. The body 40 is provided, at either lower side thereof, with an intake port 51 for intaking air of the interior space.

Figure 4:
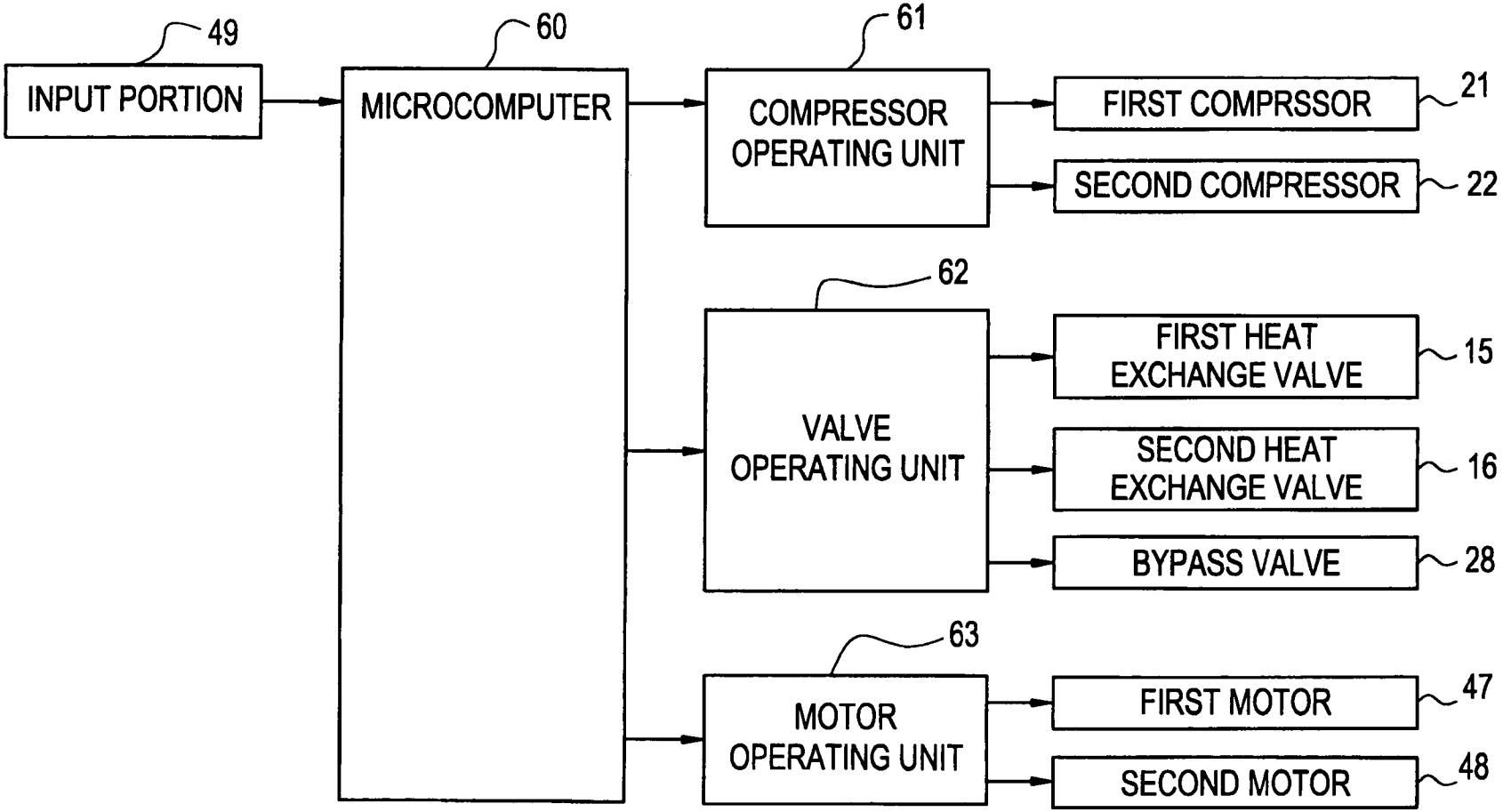
FIG. 4 is a schematic diagram showing the controller connected to various devices.

As shown in FIG. 4, the air conditioner according to one embodiment of the present invention further comprises a compressor operating unit 61 to operate each compressor (21,22), a valve operating unit 62 to operate each valve (15, 16,28), a motor operating unit 63 to operate each motor (47, 48), and a microcomputer 60 to control each component of the air conditioner.

Operations of the air conditioner shown in FIG. 1 will be described with reference to FIG. 5. When a user inputs an operation command (for instance, a first stage operation or a second stage operation) through the input portion 49, a controller, such as the microcomputer 60, determines the operation command input by the user.

If the user inputs the first stage operation, the microcomputer 60 allows the first compressor 21 to be in an ON state such that only the first compressor 21 with a smaller compressing capacity compresses the refrigerant, while maintaining the second compressor 22 in an OFF state.

Furthermore, according to the control of the microcomputer 60, the second heat exchanger valve 16 is closed and only the first heat exchanger valve 15 is opened, so that the heat exchange is carried out only in the first heat exchanger 11. Concurrently, the first motor 47 is driven to open the first discharging port 41 while closing the second discharging port 42, such that air, heat of which is exchanged in the first heat exchanger 11, is discharged through the first discharging port 41.

In the present exemplary embodiment, the refrigerant pathway is supplied with an appropriate amount of refrigerant to perform the heat exchange in the first and second heat exchangers 11 and 12. Accordingly, when performing the heat exchange only in the first heat exchanger 11 by driving the first compressor 21, since the amount of the refrigerant circulating in the refrigerant pathway is too high, a portion of the refrigerant discharged from the first compressor 21 is bypassed through the bypass pipe 27 by opening the bypass valve 28.

When performing the first stage operation with the various devices set as described above, air of the interior space taken in from the intake port 51 is supplied to the first and second heat exchangers 11 and 12, and at this time, since the second heat exchanger valve 16 and the second discharging port 42 are closed, air supplied to the first and second heat exchangers 11 and 12 undergoes the heat exchange only in the first heat exchanger 11, and is then discharged through the first discharging port 41.

Meanwhile, if the user inputs the second stage operation, the microcomputer 60 controls the second compressor 22 to be in an ON state such that only the second compressor 22, with a compressing capacity larger than the first compressor 21, compresses the refrigerant, while maintaining the first compressor 21 in an OFF state.

Furthermore, according to the control of the microcomputer 60, the first heat exchanger valve 15 is closed and only the second heat exchanger valve 16 is opened, so that the heat exchange is carried out only in the second heat exchanger 12. Concurrently, the second motor 48 is driven to open the second discharging port 42 while closing the first discharging port 41, such that air, heat of which is exchanged in the second heat exchanger 12, is discharged through the second discharging port 42.

When performing the second stage operation with the various devices set as described above, air taken in from the intake port 51 is supplied to the first and second heat exchangers 11 and 12, and at this time, since the first heat exchanger valve 15 and the first discharging port 41 are closed, air supplied to the first and second heat exchangers 11 and 12 undergoes the heat exchange only in the second heat exchanger 12, and is then discharged through the second discharging port 42.

At this time, the second compressor 22 has the compressing capacity larger than that of the first compressor 21, the second heat exchanger 12 has a heat exchanging capacity larger than that of the first heat exchanger 11, and the second discharging port 42 has a size larger than that of the first discharging port 41, whereby compared with the first operation stage, a greater amount of chilled air may be supplied to the interior space in the second operation stage.

Meanwhile, if the user inputs a third stage operation, the microcomputer 60 allows the first and second compressors 21 and 22 to be in the ON state such that the air conditioner has a cooling capacity higher than the first and second operation stages, which are the operation in a lower cooling load.

Furthermore, according to the control of the microcomputer 60, the first and second heat exchanger valves 15 and 16 are opened, so that the heat exchange is carried out both in the first and second heat exchangers 11 and 12. Concurrently, the first and second motors 47 and 48 are driven to open the first and second discharging ports 41 and 42, such that chilled air may be discharged through the first and second discharging ports 41 and 42.

When performing the third stage operation with the various devices set as described above, air taken in from the intake port 51 is supplied to the first and second heat exchangers 11 and 12, and air subjected to the heat exchange is discharged through the first and second discharging ports 41 and 42.

In the third stage operation, since both the first and second compressors 21 and 22, and the first and second heat exchangers 11 and 12 are used, the cooling capacity is high, so that the temperature of the interior space can be appropriately controlled under conditions of high cooling or heating load.

After determining the first to third stage operations, the microcomputer 60 controls the temperature of the interior space by controlling the number of rotations per minute of the indoor fan 13 or the opening amount of the electronic expansion valve 26. For instance, if the user selects the third stage operation, the microcomputer 60 sets the devices of the air conditioner as shown in the table of FIG. 5, and controls the amount of discharged air by increasing or decreasing the number of rotations of the indoor fan, thereby controlling the temperature of the interior space.

As is apparent from the description, according to the present invention, the air conditioner may be operated with various cooling or heating capacities corresponding to the changed cooling or heating load, thereby enlarging the range of the cooling or heating load.

Furthermore, the air conditioner may be operated with various cooling or heating capacities corresponding to the cooling or heating load, thereby preventing energy from being unnecessarily consumed.

Although exemplary embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A multi-stage operation air conditioner, comprising:

a first discharging port;

a first opening/closing device which opens or closes the first discharging port;

a first heat exchanger disposed at a position adjacent to the first discharging port;

a second discharging port having a size different from that of the first discharging port;

a second opening/closing device which opens or closes the second discharging port;

a second heat exchanger disposed at a position adjacent to the second discharging port;

a partition panel which prevents air passing through the first heat exchanger from being discharged to the second discharging port and prevents air passing through the second heat exchanger from being discharged to the first discharging port;

a controller which controls the air conditioner such that the air conditioner is operative with either the first discharging port or the second discharging port opened, but not both, during an operation with a lower cooling or heating load, and the air conditioner is operative with both the first and second discharging ports opened, during an operation with a higher cooling or heating load;

a first compressor driven when the first discharging port is opened; and a second compressor driven when the second discharging port is opened, and having a compressing capacity larger than that of the first compressor.

2. A multi-stage operation air conditioner, comprising:

a first discharging port;

a first opening/closing device which opens or closes the first discharging port;

a first heat exchanger disposed at a position adjacent to the first discharging port;

a second discharging port having a size different from that of the first discharging port;

a second opening/closing device which opens or closes the second discharging port;

a second heat exchanger disposed at a position adjacent to the second discharging port;

a partition panel which prevents air passing through the first heat exchanger from being discharged to the second discharging port and prevents air passing through the second heat exchanger from being discharged to the first discharging port;

a controller which controls the air conditioner such that the air conditioner is operative with either the first discharging port or the second discharging port opened, but not both, during an operation with a lower cooling or heating load, and the air conditioner is operative with both the first and second discharging ports opened, during an operation with a higher cooling or heating load, wherein the second discharging port has a size larger than that of the first discharging port, the operation with the lower cooling or heating load comprises a first stage operation for operating the air conditioner with the first discharging port opened and with the second discharging port closed, and a second stage operation for operating the air conditioner with the second discharging port opened and with the first discharging port closed, and the operation with the higher cooling or heating load comprises a third stage operation for operating the air conditioner with the first and second discharging ports opened;

a first compressor driven when the first discharging port is opened; and a second compressor driven when the second discharging port is opened, and having a compressing capacity larger than that of the first compressor.

3. A multi-stage operation air conditioner, comprising:

a first compressor for compressing a refrigerant;

a first discharging port opened only when the first compressor is driven;

a first opening/closing device which selectively opens and closes the first discharging port;

a first heat exchanger disposed at a position adjacent to the first discharging port;

a second compressor having a compressing capacity different from that of the first compressor;

a second discharging port having a size different from that of the first discharging port, and being opened only when the second compressor is driven;

a second opening/closing device which selectively opens and closes the second discharging port;

a second heat exchanger disposed at a position adjacent to the second discharging port;

a partition panel which prevents air passing through the first heat exchanger from being discharged to the second discharging port and prevents air passing through the second heat exchanger from being discharged to the first discharging port; and a controller which controls the air conditioner such that when only the first compressor is driven, only the first discharging port is opened, and when the second compressor is driven, at least the second discharging port is opened.

4. The air conditioner according to claim 3, wherein the controller controls the air conditioner such that at least one of the first discharging port and the second discharging port is opened in association with driving of the first and second compressors to perform multi-stage operations having different cooling capacities.

5. The air conditioner according to claim 4, wherein the second compressor has a compressing capacity larger than that of the first compressor, and the second discharging port has a size larger than that of the first discharging port.

6. The air conditioner according to claim 5, wherein the multi-stage operation comprises a first stage operation, with the first discharging port opened and with the second discharging port closed, for driving the first compressor while preventing the second compressor from being driven, and a second stage operation, with the second discharging port opened and with the first discharging port closed, for driving the second compressor while preventing the first compressor from being driven, and a third stage operation, with the first and second discharging ports opened, for driving the first and second compressors.

7. The air conditioner according to claim 6, further comprising:

a bypass pipe, closed in the second and third stage operations, for bypassing the refrigerant discharged from the first compressor toward an intake side of the first compressor in the first stage operation; and a bypass valve provided in the bypass pipe.

8. The air conditioner according to claim 3, wherein the second heat exchanger has a heat exchanging efficiency higher than that of the first heat exchanger.

9. The air conditioner according to claim 3, further comprising:

a first valve for controlling a flow of the refrigerant supplied to the first heat exchanger; and a second valve for controlling the flow of the refrigerant supplied to the second heat exchanger.

10. The air conditioner according to claim 9, wherein the controller controls the air conditioner such that the first valve is opened with the second valve being closed in the first stage operation, the second valve is opened with the first valve being closed in the second stage operation, and such that both the first and second valve are opened in the third stage operation.

* * * * *

UNITED STATES PATENT AND TRADEMARK OFFICE

CERTIFICATE OF CORRECTION

PATENT NO. : 7,624,587 B2
APPLICATION NO. : 11/086570
DATED : December 1, 2009
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1117 days.

Signed and Sealed this

Twenty-sixth Day of October, 2010

David J. Kappos

David J. Kappos
*Director of the United States Patent and Trademark Office*